US006332549B1

(12) United States Patent
MacDonald

(10) Patent No.: US 6,332,549 B1
(45) Date of Patent: Dec. 25, 2001

(54) REPAIR KIT FOR INDUSTRIAL PALLET RACK FRAME

(76) Inventor: Shawn D. MacDonald, 1404 Raymond, Joliet, IL (US) 60431

( * ) Notice: Subject to any disclaimer, the term of this patent is extended or adjusted under 35 U.S.C. 154(b) by 0 days.

(21) Appl. No.: 09/660,259

(22) Filed: Sep. 12, 2000

(51) Int. Cl.[7] ..... A47F 5/00
(52) U.S. Cl. ..... 211/183; 211/182; 211/189
(58) Field of Search ..... 211/189, 191, 211/190, 182, 183

(56) References Cited

U.S. PATENT DOCUMENTS

| | | | | |
|---|---|---|---|---|
| 1,315,656 | * | 9/1919 | Burgener . | |
| 2,765,086 | | 10/1956 | Weinbaum . | |
| 3,695,456 | | 10/1972 | Lewis . | |
| 4,030,611 | * | 6/1977 | Konstant | 211/191 |
| 4,074,812 | | 2/1978 | Skubic et al. . | |
| 4,113,110 | * | 9/1978 | Mittag | 211/191 |
| 4,239,122 | * | 12/1980 | Klein | 211/182 |
| 5,369,925 | * | 12/1994 | Vargo | 211/183 X |

OTHER PUBLICATIONS

URL: http://www.allpointsequipment.com; On Site Rack Repair; Allpoints Equipment Co., Last revision: May, 2000. pp. 1–3.

* cited by examiner

*Primary Examiner*—Robert W. Gibson, Jr.
(74) *Attorney, Agent, or Firm*—Richard C. Litman

(57) ABSTRACT

The repair kit for an industrial pallet rack frame has a front post having an upper end and a lower end, and an intermediate post having an upper end and a lower end. The front post and the rear post are connected by an upper cross member and a lower cross member in parallel and spaced apart relation defining a rectangular or square frame having an interior. The front and intermediate posts and the upper and lower cross members are preferably made from rectangular tubular metal stock. Both the front post and the rear post have an anchor plate attached to the lower end of the posts facing the interior of the frame. The front post has an outer clamp jaw defined by a U-shaped channel attached to its upper end, as well as a support plate perpendicular to the outer clamp jaw which caps the front post. An inner clamp jaw is removably attachable to the outer clamp jaw to clamp the front post of a pallet rack frame therebetween, the bottom of the pallet rack frame post resting on the support plate. The intermediate post includes upper and lower extension arms which terminate in rear post capture clamp jaws fixed to the extension arms. Either clamp plates or removable rear clamp jaws are used to clamp the pallet rack frame rear post to the rear post capture clamps. In an alternative embodiment, the repair kit may also include a rear post to replace a damaged pallet rack frame rear post.

12 Claims, 3 Drawing Sheets

REPAIR KIT FOR INDUSTRIAL PALLET RACK FRAME

BACKGROUND OF THE INVENTION

1. FIELD OF THE INVENTION

The present invention is related to warehouse storage pallet racks, and, more particularly, a kit for repairing front, or front and rear legs of the pallet rack frame structure which requires no welding to install.

2. DESCRIPTION OF THE RELATED ART

Pallet racks are used for warehousing and provide a number of shelves on which goods are stored upon pallets so configured as to accept the forks of a fork lift for easy placement on and removal of the palleted goods from the rack. During normal operation of the fork lift, damage may be inflicted on the rack frame due to inadvertent collisions with the rack itself. Also, corrosion may occur in the lower part of the rack frame and legs due to flooding or the presence of very humid air, or from periodic floor cleaning or maintenance using strong chemical cleaning solutions.

U.S. Pat. No. 2,765,087, issued on Oct. 2, 1956, to Weinbaum, describes a system for constructing a knock-down pallet rack which employs mechanically interconnecting standard subassemblies which require no welding. The system relies on gravity to retain the various members in place. Although the system may be readily repaired by substituting new components, it is unlikely that the rack could be repaired in place without unloading the entire rack. This rack would necessarily be more expensive and less reliable than a standard pallet rack. The present invention is a kit capable of repairing standard, existing racks in place in warehouses without unloading the rack or welding splicing members to the rack.

U.S. Pat. No. 3,695,456, issued on Oct. 3, 1972, to Lewis describes a pallet rack assembly system with mechanical interconnections between members. The present invention employs mechanical interconnections, but in the environment of a repair kit.

U.S. Pat. No. 4,074,812, issued on Feb. 21, 1978, to Skubic et al., describes post and beam components which are interchangeable with existing pallet racks and as such would be usable for repair of damaged racks. It would be necessary, however, to unload an existing rack and at least partially disassemble the rack in order to replace a post or beam with one of the '812 posts or beams. The present invention requires no unloading of the rack and no disassembly thereof.

A pallet rack repair kit has been recently marketed which is installable without unloading of the rack and requires no welding during installation. It consists of a frame with a front upright so configured as to receive the lower end of the frame upright after removal of the damaged lower portion, thereof, and to provide a mechanical splice therewith. Struts extend rearward from the kit upright and mechanically secure to the rear leg of the pallet rack frame. Hence, the force imparted by any subsequent impact to the front leg of the pallet rack is transferred to, and borne by, the rear leg of the pallet rack, which has lost some stability by loss of a cross member which normally extends between the front leg and the rear leg close to ground level.

By contrast, the repair kit of the present invention does not use the undamaged back leg of the pallet rack to support or increase the impact capacity of the repair kit. The present invention includes a second leg intermediate the damaged front leg and the rear leg of the pallet rack, together with upper and lower cross members which brace the upright legs of the repair kit in a rectangular formation, such that no additional weight must be born by the existing rear post, and, indeed, less weight must be borne by the existing rear post after kit installation.

None of the above inventions and patents, taken either singularly or in combination, is seen to describe the instant invention as claimed. Thus, a repair kit for industrial pallet rack frame solving the aforementioned problems is desired.

SUMMARY OF THE INVENTION

The repair kit for an industrial pallet rack frame has a front post having an upper end and a lower end, and an intermediate post having an upper end and a lower end. The front post and the rear post are connected by an upper cross member and a lower cross member in parallel and spaced apart relation defining a rectangular or square frame having an interior. The front and intermediate posts and the upper and lower cross members are preferably made from rectangular tubular metal stock. Both the front post and the rear post have an anchor plate attached to the lower end of the posts facing the interior of the frame. The front post has an outer clamp jaw defined by a U-shaped channel attached to its upper end, as well as a support plate perpendicular to the outer clamp jaw which caps the front post. An inner clamp jaw is removably attachable to the outer clamp jaw to clamp the front post of a pallet rack frame therebetween, the bottom of the pallet rack frame post resting on the support plate. The intermediate post includes upper and lower extension arms which terminate in rear post capture clamp jaws fixed to the extension arms. Either clamp plates or removable rear clamp jaws are used to clamp the pallet rack frame rear post to the rear post capture clamps. In an alternative embodiment, the repair kit may also include a rear post to replace a damaged pallet rack frame rear post.

The repair kit for an industrial pallet rack frame according to the present invention is a freestanding, welded assembly constructed from fabricated steel components. The repair kit is used to replace a damaged lower section on a structural or roll-formed industrial pallet rack frame and is an alternative to a complete frame replacement or a field welded spliced frame section. The repair kit does not require complete unloading of goods supported by the frame, as would be required in a complete frame replacement. The repair kit does not require any field welding as a welded splice requires, making this a much desired repair in a hazardous material, food, or drug warehouse, or where welding permits are required. The kit provides for alternative repairs, generally to replace the damaged section of the pallet rack with structural equivalents for the materials that were damaged and requiring repair. The repair kit is a very cost effective and a permanent repair due to its high impact and impact deflecting capabilities.

The repair kit is designed to replace the damaged lower post section of the pallet rack frame. The damaged section of the pallet rack frame is removed, the repair kit is inserted and the pallet rack is mechanically spliced to the repair kit. The repair kit captures and bonds the undamaged back leg of the pallet rack to the repair kit. The repair kit does not, in any way, use the undamaged back leg of the pallet rack to support, or increase the impact capacity of the repair kit. The repair kit reinforces, strengthens, captures and bonds to the repaired frame.

When the rear leg of the pallet rack frame is damaged or corroded, an optional rear post repair kit is provided to be used in conjunction with the main repair kit. The rear post repair kit is installed after removing the damaged section of the rear post of the pallet rack frame and mechanically splicing the rear post with the rear post repair kit, thereby obtaining the same advantages obtainable when connecting the repair kit to an undamaged rear post of a pallet rack frame.

Accordingly, it is a principal object of the invention to provide a repair kit for replacing damaged components of a pallet rack.

It is another object of the invention to provide a repair kit as above which is freestanding.

It is a further object of the invention to provide a repair kit as above which requires no welding to install.

It is still another object of the invention to provide a repair kit which may be installed without removal of stored goods.

It is yet another object of the invention to provide a repair kit as above which replaces the lower portion of a front upright or leg of a pallet rack without further burdening of the rear upright or leg.

It still another object of the invention as above to provide a repair kit having an intermediate leg positioned along horizontal members of the replacement frame so as to provide additional support to the rear of the pallet rack.

It is yet another object of the invention as above to provide a repair kit having capture clamps on the respective ends of the horizontal members of the replacement frame which are attachable to a rear leg or upright.

It is still another object of the invention as above to provide an additional kit component for replacement of a rear leg or upright which easily joins with the capture clamps of the horizontal members of the replacement frame of the repair kit.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a freestanding, welded assembly constructed from fabricated steel components. The repair kit is used to replace a damaged lower section on a structural or roll-formed industrial pallet rack frame and is an alternative to a complete frame replacement or a field welded spliced frame section. The repair kit does not require complete unloading of goods supported by the frame, as would be required in a complete frame replacement. The repair kit does not require any field welding as a welded splice requires, making this a much desired repair in a hazardous material, food, or drug warehouse, or where welding permits are required. The kit provides for alternative repairs, generally, to replace the damaged section of the pallet rack with structural equivalents for the materials that were damaged and requiring repair. The repair kit is a very cost effective and a permanent repair due to its high impact and impact deflecting capabilities. The repair kit is designed to replace the damaged lower post section of the pallet rack frame. The damaged section of the pallet rack frame is removed, the repair kit is inserted and the pallet rack is mechanically spliced to the repair kit. The repair kit captures and bonds the undamaged back leg of the pallet rack to the repair kit. The repair kit does not, in any way, use the undamaged back leg of the pallet rack to support, or increase the impact capacity of the repair kit. The repair kit reinforces, strengthens, captures and bonds to the repaired frame.

When the rear leg of the pallet rack frame is damaged, an optional rear post repair kit is provided to be used in conjunction with the main repair kit. The rear post repair kit is installed after removing the damaged or corroded section of the rear post of the pallet rack frame and mechanically splicing the rear post with the rear post repair kit, thereby obtaining the same advantages obtainable when connecting the repair kit to an undamaged rear post of a pallet rack frame. The optional rear post repair kit is provided when the existing rear post is damaged or corroded, which is easily integrated with the basic front post repair kit of the present invention.

Figure 1:
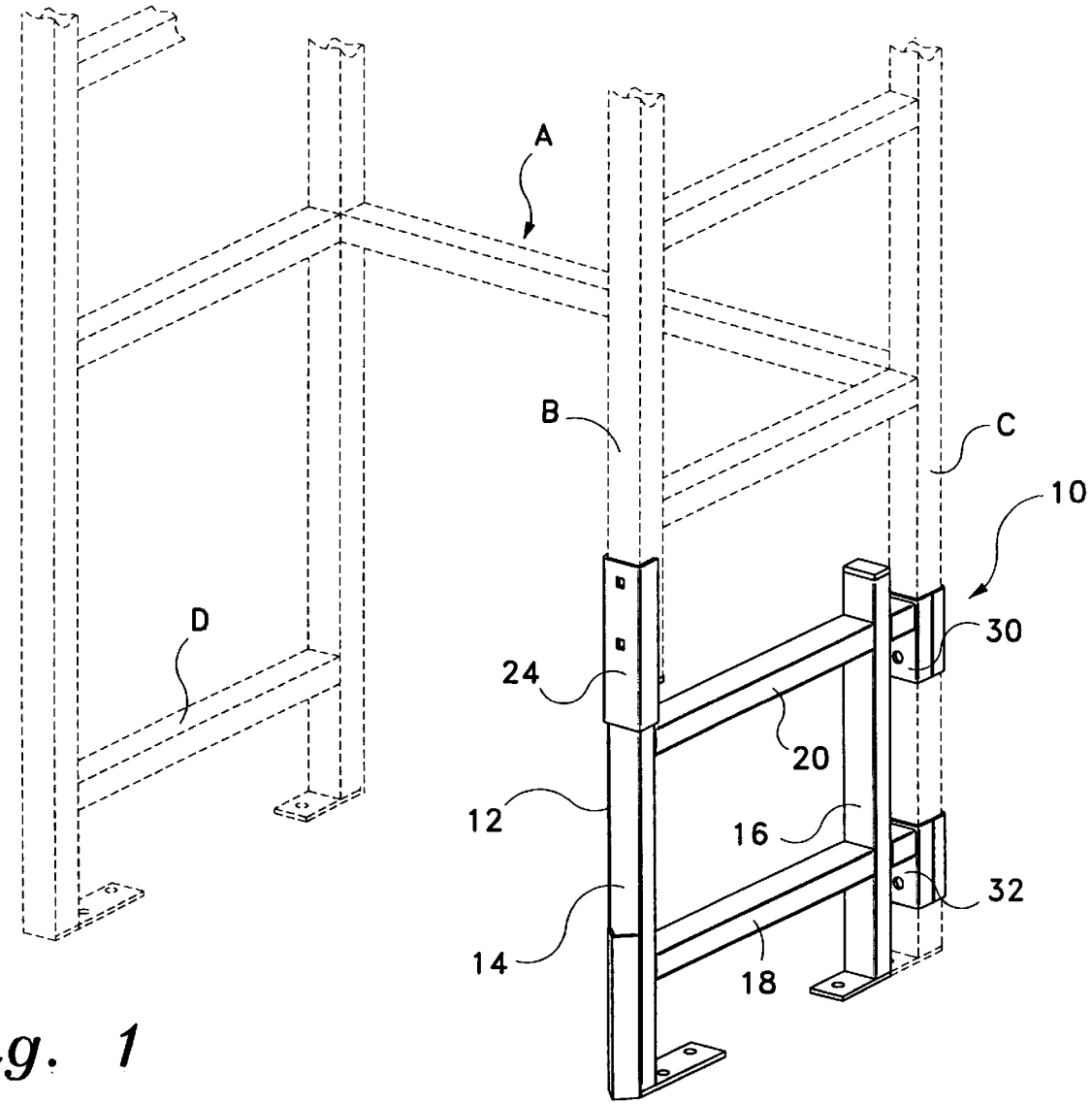
FIG. 1 is an environmental, perspective view of a repair kit for an industrial pallet rack frame according to the present invention.
Figure 2:
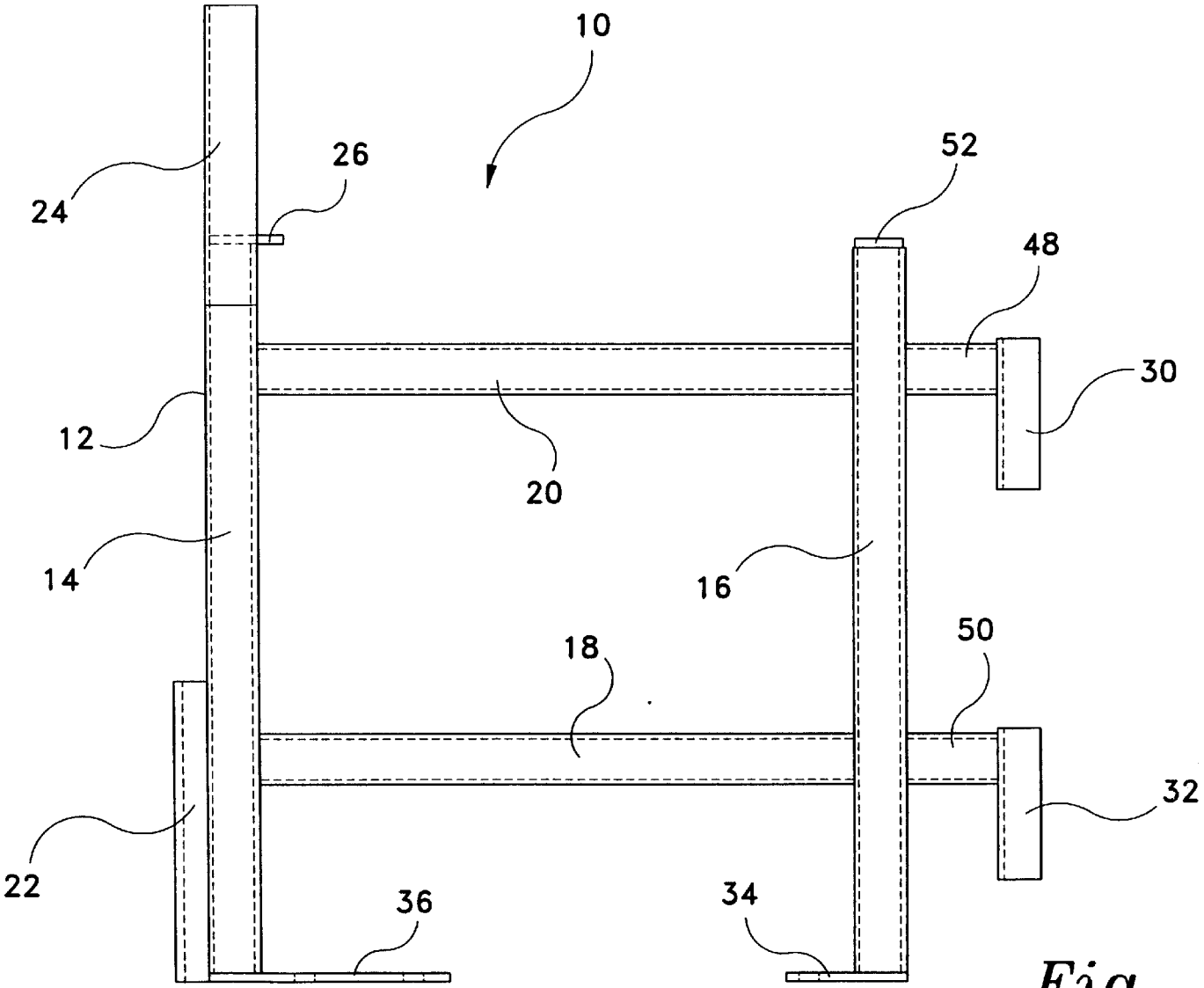
FIG. 2 is an elevational view of the a pallet frame repair kit according to the present invention.

Referring to FIGS. 1 and 2, there are shown an environmental perspective view and a perspective view of a first embodiment of the pallet rack frame repair kit 10 of the present invention. As shown in FIG. 1, the pallet rack frame A includes a plurality of standards, including front B and rear C standards. The standards B and C may be made from U-shaped posts or square or rectangular tubular material. The standards are usually supported or braced by a pair of lower cross members D (only one shown in the background in FIG. 1, the cross member which would otherwise be in the foreground having been removed and replaced by the repair kit 10) extending between the front B and rear C standards about four to six inches above floor level. Fork lifts are generally used to lift pallets and place them on the pallet racks A. From time to time the front standard B may be damaged either by direct impact from the fork lift, or from impact by the pallets when the fork lift does not center the pallets properly between the standards. The impact from the fork lift and pallets may not only damage the front standard B, but may also compress and bend the cross member D and weaken or damage the rear post C. Rather than replace the entire rack frame A, the repair kit 10 of the present invention may be used to repair the damage and provide a stable support for the pallet rack A.

The damaged portion of the rack is removed by appropriate metal cutting tools, such as electrically powered saws. The bottom (damaged) portion of the front upright B is removed and trimmed, and the cross member D is removed. Pallet rack repair kit 10 is attached to pallet rack A (see FIG. 1), replacing the lower part of front upright B, and is attached by capture clamp members to rear upright C. Frame 12 (see FIGS. 1 and 2) is of welded tubular metal and is defined by front post 14 and parallel intermediate post 16 connected by lower frame cross member 18 and upper frame cross member 20 spaced apart and parallel to lower frame cross member 18 defining a generally rectangular or square frame, the upper ends of the front 14 and intermediate 16 posts extending beyond the junction of upper cross member 20 with the posts 14 and 16, and the lower ends of the front 14 and intermediate 16 posts extending below the junction of lower cross member 18 with the posts 14 and 16, the posts 14 and 16 defining an interior of the frame 12. Preferably, front post 14, intermediate post 16, and cross members 18 and 20 are made from rectangular, tubular, metal stock, such as 2"×3" steel tubing, although aluminum alloys or other structural material may be used.

Angle deflector 22, made of angle iron, is mounted on the lower portion of front post 14 such that the bend in the angle faces forward, thus deflecting collisions from equipment such as forklifts and reinforcing the base of front post 14. Front post outer clamp jaw 24, having a channel or U-shape sized and dimensioned for receiving front post 14, is permanently mounted on the upper end of front post 14, as by welding, and features front post upper support plate 26, which caps front post 14 and extends towards the interior of frame 12, and front post inner clamp 28 removably attachable by bolts or other fasteners to outer clamp jaw in order to accept, support, and mechanically grip the free end or cutoff of the original rack frame front post A, which rests on support plate 26 and is clamped between outer clamp jaw 24 and inner clamp 28. (For clarity, no fastening bolts or similar hardware are illustrated.)

Upper capture clamp 30 attaches to either the original rear post C (see FIG. 1), or the optional rear post replacement kit (see FIG. 3) of the present invention at a point which is at about the same elevation as upper frame cross member 20. Lower capture clamp 32 is similarly employed at about the same elevation as lower frame cross member 18. Upper 30 and lower 32 capture clamps are preferably made from U-shaped channels sized and dimensioned for receiving rear post C. Upper capture clamp 30 is permanently attached to intermediate post 16, as by welding, at about the same elevation as upper frame cross member 20 by means of upper extension arm 48, which projects to the exterior of the frame 12. Lower capture clamp 32 is similarly employed at about the same elevation as lower frame cross member 18 by means of lower extension arm 50. The rear post C is removably attached to the frame 12 either by U-shaped clamp jaws 60 and 62 or flat clamp plates which are attached to upper 30 and lower 32 capture clamps by bolts or other fasteners.

Intermediate post 16 has an anchor plate 34 at its lower end perpendicular to the post 16 and extending towards the interior of the frame 12. Similarly, front post 14 has an anchor plate 36 at its lower end perpendicular to the post 14 and extending towards the interior of the frame 12. Although the frame 12 may be free standing on the anchor plates 34 and 36, preferably the anchor plates 34 and 36 are bolted to the floor through apertures defined in the anchor plates 34 and 36 to provide a firm and immovable base for the pallet rack A.

Figure 3:
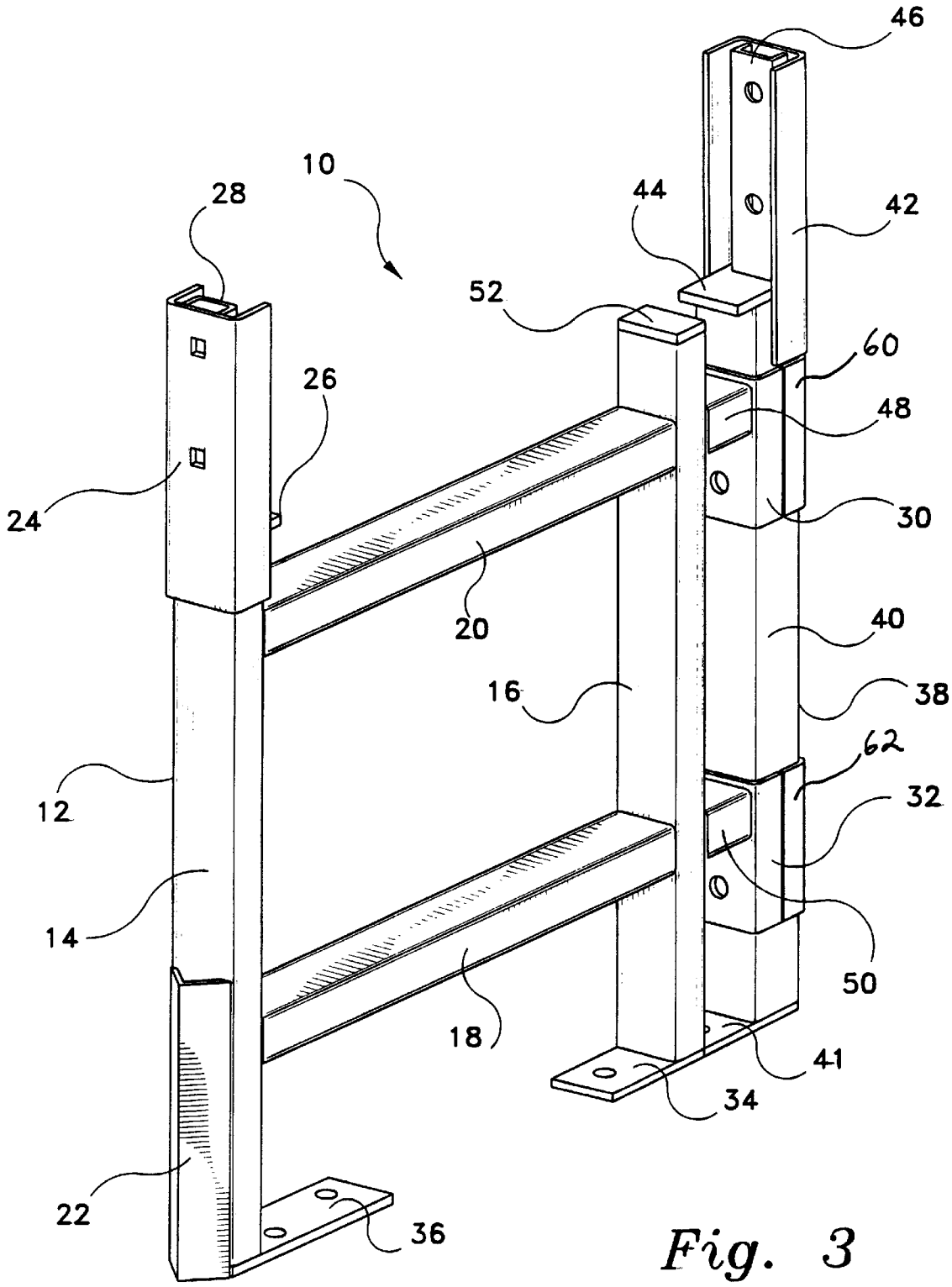
FIG. 3 is a perspective view of an alternate embodiment of a repair kit for an industrial pallet rack frame according to the present invention with optional rear post in place.

As is seen in FIG. 3, optional rear leg assembly 38 includes rear post 40, which is tubular in design and stands upright, parallel to front post 14 and intermediate post 16, and rests upon rear post anchor plate 41. Rear post outer clamp 42 is mounted on the upper end of rear post 40 and features rear post upper horizontal plate 44 and post inner clamp 46 so disposed as to accept, support, and mechanically grip the free end or cutoff of the original rack frame rear post.

In operation, the damaged pallet rack front post B is cut at an appropriate height to match the elevation of front post upper horizontal plate 26. Any cross pieces are removed from the replacement area. The shelf above the repair area may be supported by a forklift or jack during the repair. It is not necessary to unload the shelves while the repair is carried out. The pallet rack repair kit is selected to match the particular rack configuration. The repair kit is then put in place with the remaining rack post being clamped into place by front post outer clamp 24 and front post inner clamp 28 by means of appropriate bolts or screws (not shown), while resting on front post upper anchor plate 26. Upper capture clamp 30 and lower capture clamp 32 are engaged with the rear post of the existing rack and are secured by appropriate bolts or equivalent means.

In the case of a damaged rear post, the rear post is cut off at on appropriate level to match the optional rear leg assembly 38. The rear post assembly 38 is put in place and the original rear post is held in place by rear post outer clamp 42 and rear post inner clamp 46, by any appropriate means such as bolts (not shown) and rests on rear post upper horizontal plate 44. Upper capture clamp 30 and lower capture clamp 32 are then attached to the rear post 40 by appropriate means such as by bolts (not shown). The repair is then complete.

It is to be understood that the present invention is not limited to the embodiments described above, but encompasses any and all embodiments within the scope of the following claims.

I claim:

1. A repair kit for an industrial pallet rack frame comprising:

a) a front post having an upper end and a lower end;

b) an intermediate post having an upper end and a lower end;

c) an upper cross member joining said front post to said intermediate post;

d) a lower cross member joining said front post to said intermediate post, said lower cross member being parallel to and spaced apart from said upper member, the front and intermediate posts and the upper and lower cross members defining a rectangular frame;

e) front post clamping means including a front post outer clamp jaw fixedly attached to the upper end of said front post and a front post inner clamp jaw removably connectable to said outer clamp, said front post clamping means for clamping a front standard of a pallet rack frame between said jaws; and f) intermediate post clamping means for clamping a rear standard of the pallet rack frame to said intermediate post; and g) ground engaging means at the lower ends of said front post and said intermediate post, respectively, so that a load applied by the pallet rack frame to the repair kit and an impact force applied to said front post are distributed to the ground through the lower ends of said posts.

2. The pallet rack repair kit of claim 1, further comprising an angle deflector attached to a front lower portion of said front post.

3. The pallet rack repair kit of claim 1, further comprising a support plate capping said front post upon which the front post of the pallet rack frame rests.

4. The pallet rack repair kit of claim 1, wherein said ground engaging means comprises:

a) a first anchor plate attached to the lower end of said intermediate post; and b) a second anchor plate attached to the lower end of said front post.

5. The pallet rack repair kit of claim 4, wherein said first anchor plate and said second anchor plate each further comprise at least one aperture defined therein for attaching said plates to a horizontal support surface.

6. The pallet rack repair kit of claim 1, wherein said frame is free standing.

7. The pallet rack repair kit according to claim 1, further comprising:

a) a first extension arm projecting from said intermediate post at the level of said upper cross member;

b) a second extension arm projecting from said intermediate post at the level of said lower cross member; and c) wherein said intermediate post clamping means comprises a first clamp attached to said first extension arm and a second clamp attached to said second extension arm.

8. The pallet rack repair kit of claim 7 further comprising a rear leg assembly having a rear post and an upper clamp located on the upper end of said rear post for clamping a rear post of a pallet rack frame to the rear leg assembly, said intermediate post clamping means attaching the rear leg assembly to said rectangular frame.

9. The pallet rack repair kit of claim 8, wherein said rear post upper clamp comprises a rear post outer clamp attached to said rear post and an inner clamp connectable to said outer clamp so as to engage the rear post of the pallet rack frame.

10. The pallet rack repair kit of claim 9, further comprising a rear post upper horizontal plate upon which the rear post of the pallet rack frame rests.

11. The pallet rack repair kit of claim 8, further comprising a rear post anchor plate upon which said rear post of said rear leg assembly rests.

12. A repair kit for an industrial pallet rack frame comprising:

a) a front post having an upper end and a lower end;

b) an intermediate post having an upper end and a lower end;

c) an upper cross member joining said front post to said intermediate post;

d) a lower cross member joining said front post to said intermediate post, said lower cross member being parallel to and spaced apart from said upper member, the front and intermediate posts and the upper and lower cross members defining a rectangular frame;

e) front post clamping means for clamping a front standard of a pallet rack frame to said front post; and f) intermediate post clamping means for clamping a rear standard of the pallet rack frame to said intermediate post;

g) ground engaging means at the lower ends of said front post and said intermediate post, respectively, so that a load applied by the pallet rack frame to the repair kit and an impact force applied to said front post are distributed to the ground through the lower ends of said posts;

h) a first extension arm projecting from said intermediate post at the level of said upper cross member;

i) a second extension arm projecting from said intermediate post at the level of said lower cross member; and j) wherein said intermediate post clamping means comprises a first clamp attached to said first extension arm and a second clamp attached to said second extension arm.

* * * * *